US008302354B2

(12) United States Patent
Quesada

(10) Patent No.: US 8,302,354 B2
(45) Date of Patent: Nov. 6, 2012

(54) WINDOW OR DOOR FRAME RECEPTOR BUCK AND RECEPTOR BUCK SYSTEM

(75) Inventor: Flavio Quesada, Miami, FL (US)

(73) Assignee: CGI Windows & Doors, Miami, FL (US)

( * ) Notice: Subject to any disclaimer, the term of this patent is extended or adjusted under 35 U.S.C. 154(b) by 224 days.

(21) Appl. No.: 12/418,794

(22) Filed: Apr. 6, 2009

(65) Prior Publication Data

US 2010/0251644 A1 Oct. 7, 2010

(51) Int. Cl.
*E06B 1/02* (2006.01)
*E06B 1/04* (2006.01)
*E06B 1/60* (2006.01)

(52) U.S. Cl. ..... 52/215; 52/204.1; 52/204.5

(58) Field of Classification Search ..... 52/215, 52/211, 212, 204.1, 204.5, 846; 49/467
See application file for complete search history.

(56) References Cited

U.S. PATENT DOCUMENTS 1,837,748 A * 12/1931 Baum ..... 52/211
2,697,932 A 12/1954 Goodwin
3,284,971 A * 11/1966 Attwood ..... 52/100
3,345,787 A * 10/1967 Busscher ..... 52/242
3,526,074 A * 9/1970 Miller ..... 52/844
3,919,815 A 11/1975 Alabaster
4,004,370 A * 1/1977 Heaney ..... 49/70
4,056,180 A * 11/1977 Gunti ..... 193/35 J
4,172,677 A * 10/1979 Gunti ..... 403/189
4,793,109 A * 12/1988 Noach ..... 52/211
5,293,723 A * 3/1994 Slessor ..... 52/213
5,392,574 A 2/1995 Sayers
5,456,189 A * 10/1995 Belle Isle ..... 108/57.17
5,533,308 A * 7/1996 Fullwood ..... 52/204.5
5,555,682 A * 9/1996 Colitto ..... 52/100
5,596,851 A * 1/1997 Ting ..... 52/211
5,675,937 A * 10/1997 Stebel ..... 49/453
5,746,032 A * 5/1998 Koike et al. ..... 52/204.1
5,857,298 A * 1/1999 Fullwood ..... 52/202
5,887,392 A * 3/1999 Martin ..... 52/204.5
6,122,864 A * 9/2000 Martin ..... 49/428
6,158,182 A * 12/2000 Biebuyck ..... 52/235
6,223,489 B1 * 5/2001 Fisher ..... 52/308
7,086,204 B2 * 8/2006 Salzer ..... 52/208
RE40,041 E 2/2008 Sayers
7,392,623 B2 * 7/2008 Back et al. ..... 52/93.1
7,533,501 B2 * 5/2009 Neal ..... 52/204.54
7,845,124 B1 * 12/2010 Neal ..... 52/204.1
7,941,982 B2 * 5/2011 Merica ..... 52/235
2002/0078640 A1 * 6/2002 Petta ..... 52/204.1
2002/0129573 A1 * 9/2002 Biebuyck ..... 52/235
2003/0163970 A1 * 9/2003 Moore et al. ..... 52/731.5
2003/0221381 A1 12/2003 Ting
2004/0226232 A1 11/2004 Engebretson
2004/0255529 A1 * 12/2004 Pielmeier ..... 52/212
2005/0284046 A1 * 12/2005 Neal ..... 52/204.5
2006/0156655 A1 * 7/2006 Rizzotto, Sr. ..... 52/215
2006/0265977 A1 11/2006 Powers, Jr.

* cited by examiner

*Primary Examiner* — Robert Canfield
(74) *Attorney, Agent, or Firm* — Greenblum, Bernstein, P.L.C.

(57) ABSTRACT

A receptor buck and receptor system for securing a window or door frame. The receptor buck includes a longitudinal rack, a surface of the rack that includes an aperture for accepting a first fastener to fasten the rack to a wall opening surface, and another surface that includes another aperture for accepting a second fastener to fasten the window or door frame to the rack. The receptor system includes the rack, the first and second fasteners, and the fasteners extend in generally the same direction.

31 Claims, 14 Drawing Sheets

WINDOW OR DOOR FRAME RECEPTOR BUCK AND RECEPTOR BUCK SYSTEM

BACKGROUND OF THE INVENTION

1. Field of the Invention

The present invention relates to a window or door frame receptor buck and a receptor buck system for a window or door frame, and more particularly relates to installing an impact-resistant receptor buck system.

2. Background and Material Information

Conventional receptor systems are generally made up of one or more members to secure a window or a door frame to a surface of a wall opening of a structure. Such receptor is used to fit the frame and often provide tolerance to the wall opening. Conventional receptors hold the frame by friction, adhesive or fasteners. In other words, the window or door generally "floats" inside the wall opening. However, conditions such as seal degradation, cracks in masonry, extreme weather, excessive structural loading, structural fatigue failure, and periodic thermal contraction and expansion often jeopardize the condition of conventional receptor systems, as well as increase the tendency for the frame panel to displace and/or rotate. Thus, frequent inspections and maintenance are required for conventional receptor systems. Further, conventional receptor systems, which secure the frames by friction or adhesive, fail to provide a secure window system to withstand an impact such as a strong wind, and is especially vulnerable to hurricanes and other forces. In certain unfortunate conditions, an impact-resistant window/door and its frame may nevertheless be blown out of the opening by a strong wind if installed using the aforementioned "floating" installation method, since an impact resistant window or door installation is only as strong as its weakest link.

FIG. 12 shows a schematic view of an upper portion of a conventional two-part receptor system 200 having a receptor 201, a window frame 202 and a fastener 203. The receptor 201 is secured to a wall opening surface 204 using a fastener (e.g., a screw) 203 while it engages with the window frame 202 by friction via weather-stripping 205*a,b* between the inner surfaces 206*a,b* of receptor 201 and the outer surfaces 207*a,b* of frame 202. Also, the receptor 201 can only accept a certain load imposed by frame 202. Additionally, the weather-stripping used in the conventional receptor system, which is exposed to the elements, will eventually wear out, making this already-unsecure connection weaker.

FIG. 13 shows another known receptor system 300, which does not provide any opening tolerances. Receptor system 300 includes a receptor 301 and a window frame 302. The receptor 301 includes lips 303*a,b* to engage with extensions 304*a,b* of frame 302, respectively. Perimeter sealants 304*a,b* are applied to secure the clip-on connections between the receptor 301 and frame 302, as shown in FIG. 13. Receptor system 300 experiences similar problems as the conventional receptor system 200 shown in FIG. 12. For example, the lips 303*a,b* must be especially designed to engage with extensions 304*a,b*.

Some receptor systems use a fastener (e.g., a screw) to secure the window frame to the receptor; however, these fasteners are inserted from the side and sometimes only from a single side. In such configuration, the window frame cannot usually withstand a substantial impact because the load imposed by the glass panel is exerted towards one side of the frame. Additionally, without installing any moldings, the horizontally-inserted side fastener(s) would be exposed from the exterior and/or interior side of the receptor, thus affecting the appearance of the frame and making the connection susceptible to damages from weathering.

SUMMARY OF THE INVENTION

A non-limiting feature of the present disclosure to enhance the receptor system by reinforcing the connection between the frame and the receptor buck, thereby allowing the same to withstand extreme weather conditions, including hurricanes. The present disclosure employs a fastener (e.g. a screw or bolt) to secure the frame to the receptor buck. In addition, the receptor buck may be used with a flange-frame window and/or door frames to help conceal any gaps between the wall opening and the frame; however, the receptor buck may also be used with other (non-flange) types of frames. The present disclosure also reduces the degradation rate of the system by, e.g., concealing certain seals to the elements, and improves the overall appearance and minimizes the maintenance costs of the receptor system.

It is another non-limiting feature of the present disclosure to be able to set up a receptor system using generic window or door frames, thereby resulting in a virtually universal receptor system. By fastening the frame to the receptor buck, the receptor system according the present disclosure can be used with generic window or door frames having various shapes, weights, heights and widths. In addition, an additional receptor buck can be installed directly below the top of the wall opening to enhance the stability the entire receptor system. Accordingly, in rectangular openings, any number of one to four receptor bucks may be used, and in other non-rectangular openings, any number of one to all sides of the openings may have a receptor buck.

A further non-limiting feature of the present disclosure is to provide a seamless transition between the receptor buck and the frame by concealing the gaps thereon. The present disclosure also increases the tolerance range in the dimension of the wall opening by adding and removing shims above and/or below the receptor buck to fill gaps between the receptor system and the wall opening.

The receptor buck includes a rack that extends in a generally longitudinal direction, where a first surface on the rack includes a first aperture for accepting a first fastener to fasten the rack to a wall opening surface and a second surface on the rack is configured to receive a second aperture thereon. The second aperture accepts a second fastener to fasten the window or door frame to the rack. Further, the second aperture is configured to accept the second fastener so that the second fasteners extends in generally the same direction as the first fastener. The first and second surface may also be different and/or located on different planes. The second surface may be located on a plane above the first surface. Both surfaces may extend in generally the same direction as the rack. The second surface of the rack may extends orthogonally past an upright wall of the frame.

The rack may have a generally W-shaped or rectangular cross-section. It may also be configured to accept a flange of the window or door frame. The rack may also fit generally completely under the door or window frame.

The receptor buck may further include a third surface facing the exterior of the structure, where the third surface is configured to accept a back-bed sealant. The third surface may also accept a perimeter sealant. A portion of the third surface may touch the flange of the window or door frame.

The receptor buck may further comprise at least a channel extended from the rack, where such channel faces the interior of the structure. Such channel (or similar provisions) may also be used to accept an interior jamb cover.

The rack of the receptor buck may be of unitary construction. It may also be hollow or partially or completely solid.

Also provided is a receptor system for securing a window or door frame. The system includes a receptor buck having a rack extending in a generally longitudinal direction, a first fastener for fastening the rack to a wall opening surface through an aperture on a first surface of the rack, and a second fastener for fastening the window or door frame to the rack through an aperture on a second surface of the rack. The second fastener extends in generally the same direction as the first fastener. Each of the fasteners may be a screw or bolt.

A shim may be installed between the rack and the window or door frame. The shim may extend in generally the same direction as the receptor buck. The shim may comprise an aperture to accept the second fastener. Alternatively or additionally, a shim may be installed between the rack and the wall opening surface. The shim may further include an aperture to accept the first fastener. At least the first fastener may be concealed.

The receptor buck may be selectively installed to a section of the wall opening surface and the shape of the receptor buck may be configured to match the shape of the wall opening.

The system may further include an interior jamb cover that faces the interior of the structure. The interior jamb cover may comprise at least a projection and extend in generally the same direction as the rack. The projection of the interior jamb cover may be attached to a channel of the rack. The interior jamb cover may also be configured to be adhered onto an interior surface of the rack of the receptor buck.

The receptor system may further include an exterior molding attached to the rack of the receptor buck and facing the exterior of the structure. The exterior molding may extend in generally the same direction as the rack. The exterior molding may be selectively installed to a section of the wall opening surface.

The receptor system may further include a perimeter sealant to seal a gap among the rack of the receptor buck, the window or door frame and the wall opening surface.

The edge of the window or door frame may comprise a flange or lip portion. A back-bed sealant may be configured to seal the gap between the outer surface of the rack and the inner surface of the flange or lip portion. The window or door frame may also comprise a projection for exerting a load of the frame to the second surface of the rack.

Also provided is a method for securing the window or door frame to the wall opening surface using a receptor buck, which the receptor buck includes a rack extending in a generally longitudinal direction. The method includes fastening the rack of the receptor buck to the surface of the wall opening through a first aperture on a first surface of the rack using a first fastener, and fastening the window or door frame to the rack through a second aperture on a second surface on the rack using a second fasteners, wherein the second fastener extends in generally the same direction as the first fastener.

The method may further include inserting a shim between the window or door fame and the rack, wherein the shim extends in generally the same direction as the rack. Alternatively and additionally, a shim may be inserted between the rack and the wall surface opening and extended in generally the same direction as the rack.

The method may also include sealing a gap between the rack, the window or door frame and the wall opening surface using a perimeter sealant.

Also provided is a method for fitting a window or door frame to a wall opening surface using a receptor buck when the dimension of the wall opening is smaller than a predetermined dimension, where the receptor buck includes a rack extending in a generally longitudinal direction. The method includes fastening the rack of the receptor buck to the wall opening surface through a first aperture on a first surface on the rack of the receptor buck using a first fastener, removing a shim originally configured to be inserted between the widow or door frame and the rack, wherein the shim extends in generally the same direction as the rack, and fastening the window or door frame to the rack through a second aperture on a second surface on the rack using a second fastener. The second fastener extends in generally the same direction as the first fastener. The method may further include replacing the original shim with a second shim of a lower height than the original shim, wherein the second shim extends in generally the same direction as the rack.

Other exemplary embodiments and advantages of the present disclosure may be ascertained by reviewing the present disclosure and the accompanying drawings.

BRIEF DESCRIPTION OF THE DRAWINGS

The present disclosure is further described in the detailed description which follows, in reference to the noted plurality of drawings by way of non-limiting examples of preferred embodiments of the present disclosure, in which like numerals represent like elements throughout the several views of the drawings, and wherein.

DETAILED DESCRIPTION OF THE PREFERRED EMBODIMENTS

The particulars shown herein are by way of example and for purposes of illustrative discussion of the embodiments of the present disclosure only and are presented in the cause of providing what is believed to be the most useful and readily understood description of the principles and conceptual aspects of the present disclosure. In this regard, no attempt is made to show structural details of the present disclosure in more detail than is necessary for the fundamental understanding of the present disclosure, the description taken with the drawings making apparent to those skilled in the art how the several forms of the present disclosure may be embodied in practice.

Figure 1:
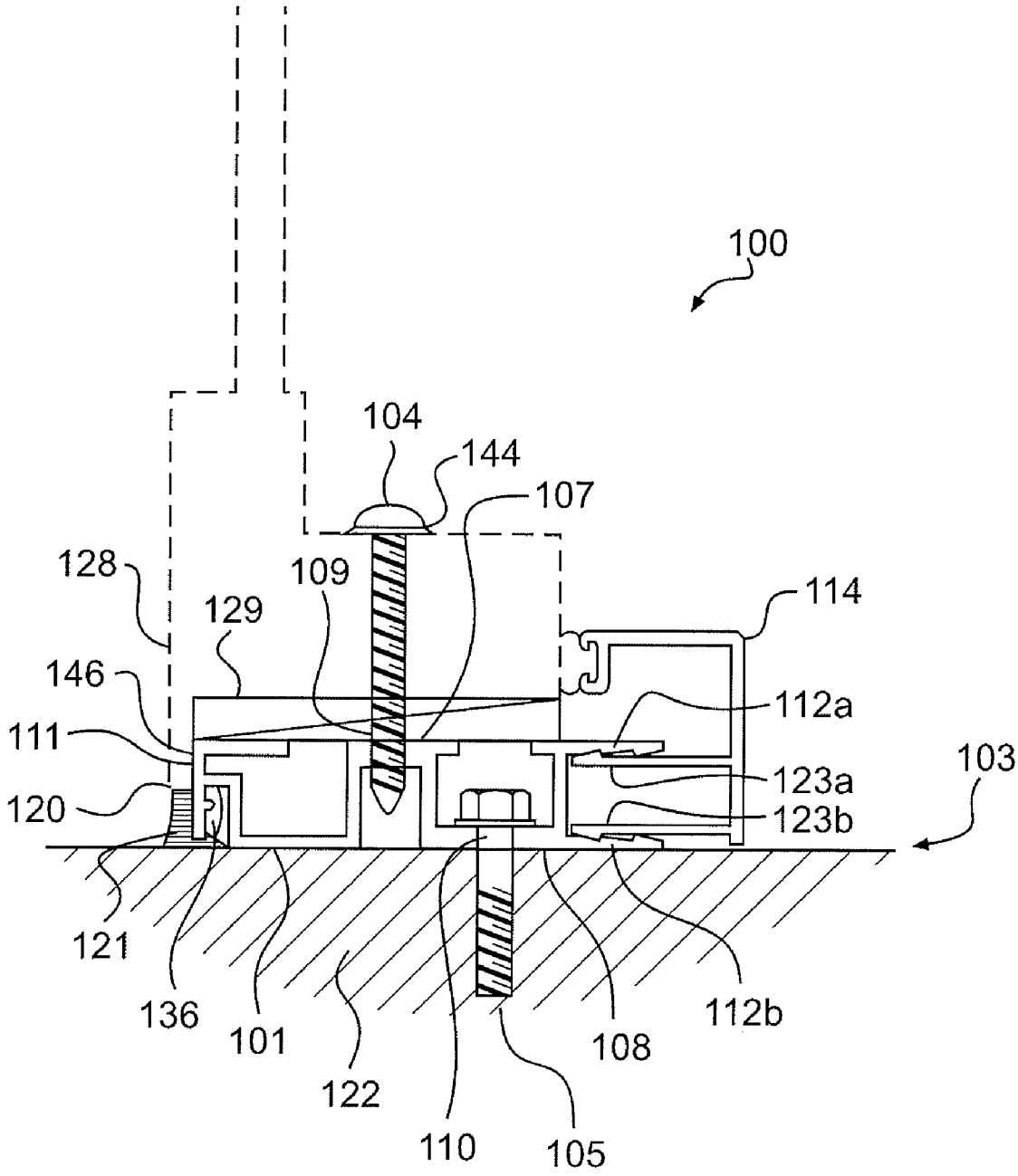
FIG. 1 is a partial cross sectional drawing illustrating one embodiment of the window or door receptor system in an original design condition according to the present disclosure.
Figure 2:
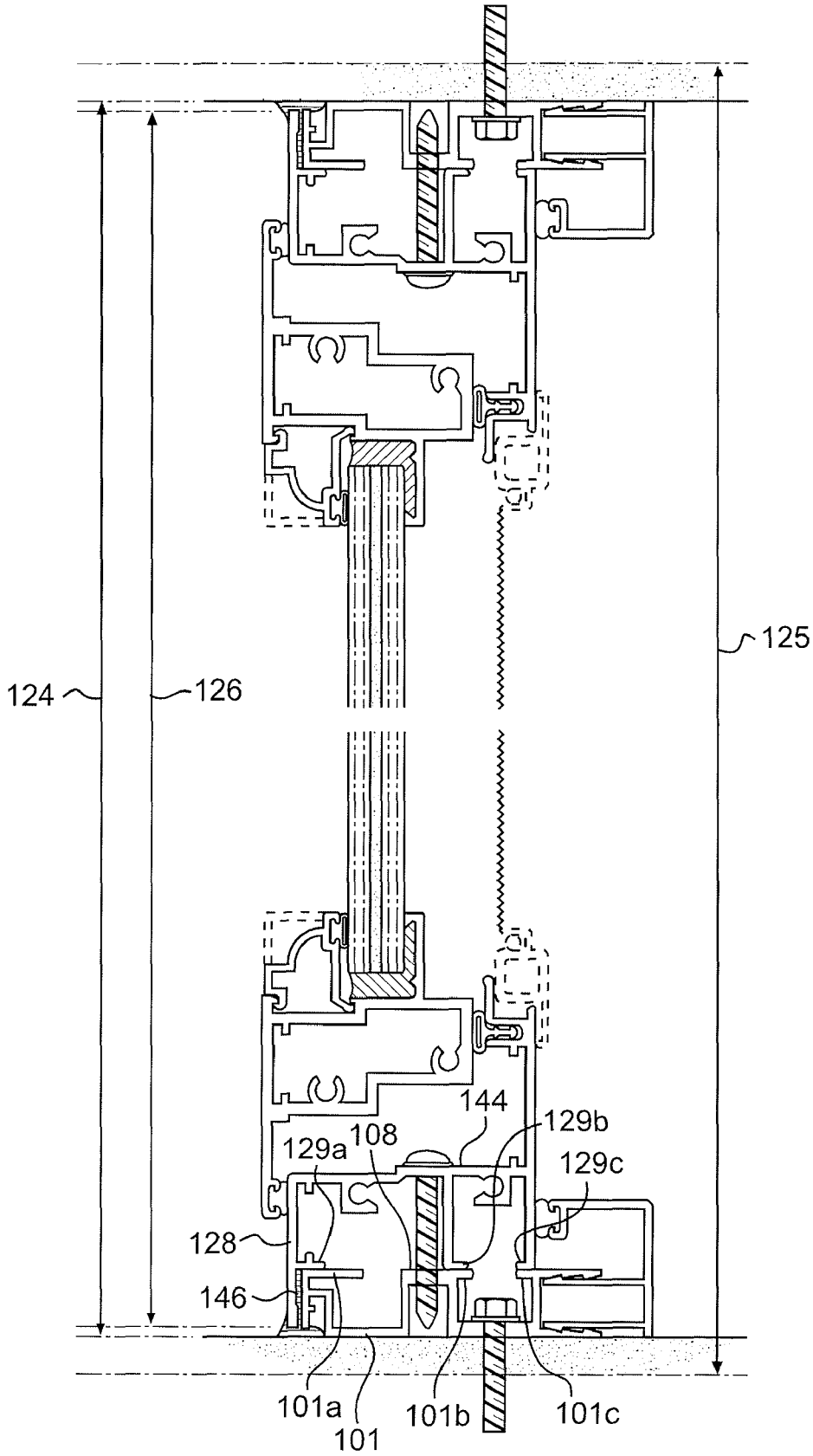
FIG. 2 is a cross sectional drawing illustrating the receptor system illustrated in FIG. 1 when the dimension of the actual opening is smaller than the predetermined design dimension according to the present disclosure.

Referring to the drawings wherein like characters represent like elements, FIG. 1 schematically illustrates a receptor system 100 for a window or door frame 128 in accordance with one embodiment of the disclosure. This particular receptor system 100 employs a receptor buck 101 to secure a generic window frame to a wall opening surface 103. The receptor system 100 can be installed in conjunction with openings of various types of wall materials, i.e., cement, masonry, stone, brick, wood or any other suitable material. The receptor system 100 can also be installed on even and/or uneven surfaces. With respect to FIGS. 2 and 3, like reference numbers are used in FIGS. 1-3 to indicate similar structures. While FIG. 1 shows the receptor buck 101 with a shim 127 between the receptor buck and flange-frame door/window 128 (since the opening of FIG. 1 is presumably to be larger than the opening of FIG. 2), FIG. 2 shows the receptor buck 101 with no shim implemented between the receptor buck and flange-frame door/window 128. The receptor buck 101 may be installed with a window or door frame 128 that has flange 120 (or lip) on the outside to cover any gap existed between the receptor buck 101 and the window or door frame 128 at certain installation tolerance conditions, although this is not a requirement for the system to work.

Figure 3:
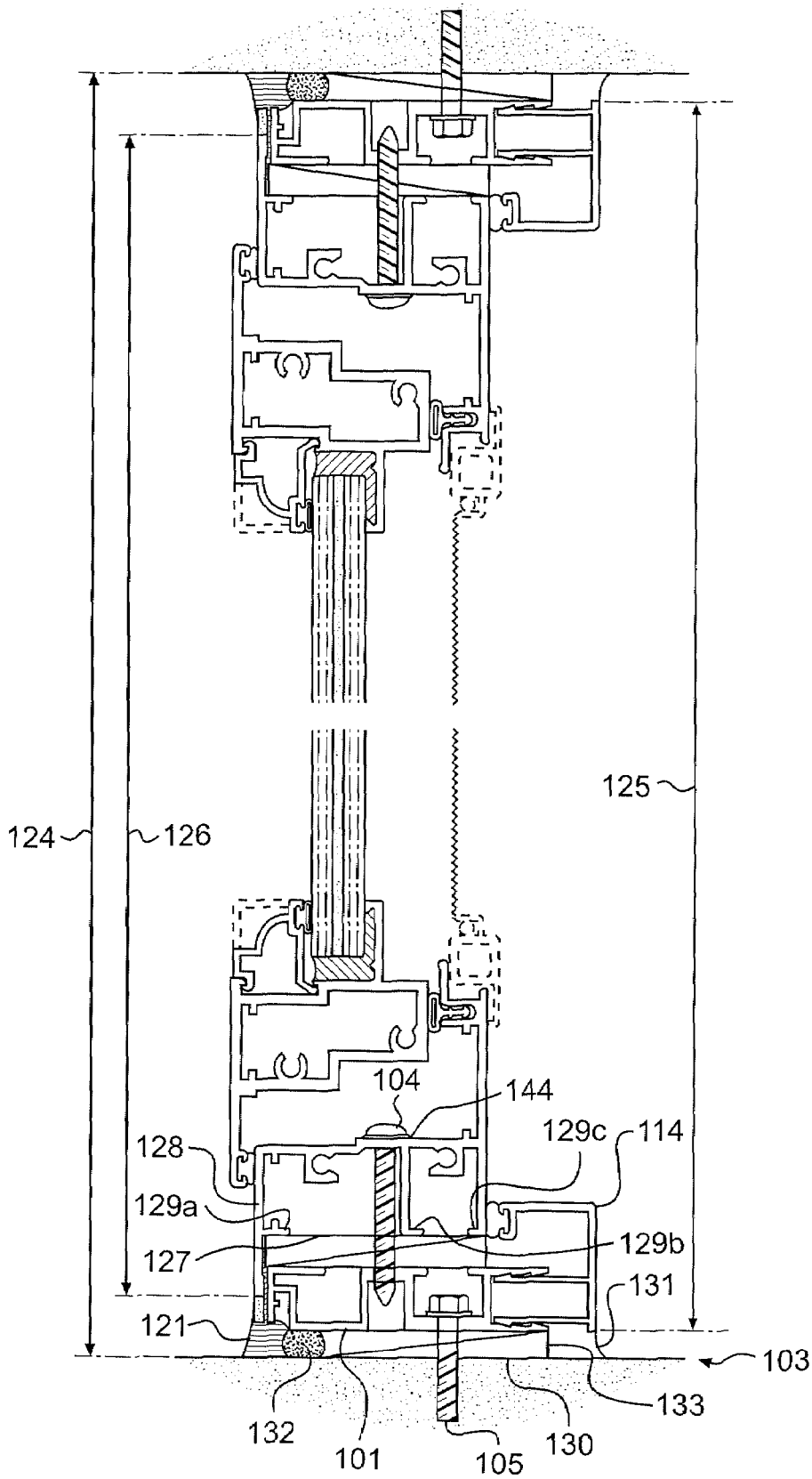
FIG. 3 is a cross sectional drawing illustrating the receptor system illustrated in FIG. 1 when the dimension of the actual opening is larger than the predetermined design dimension according to the present disclosure.

In FIG. 3, an additional shim, such as a base shim 130, is added between the receptor buck 101 and the wall opening surface 103 when the dimension of the wall opening 124 is larger than the predetermined design dimension 125. FIGS. 1-3 thus reflect a tolerance range of the wall opening with which the receptor system 100 of the present disclosure is intended to be used.

The receptor buck system 100 generally includes at least a receptor buck 101 to be used with an upper fastener 104 and a base fastener 105. As described herein, the right side of FIGS. 1-11 will be generally referred to as "interior" of the structure and the left side of the figures may be referred to as the "exterior" of the structure. The upper fastener is preferably a #14 SMS stainless steel screw and the lower fasteners are preferably ¼" 0 tap-con screws, although it is appreciated by those skilled in the art that any suitable fasteners may be used as the upper fastener 104 and base fastener 105. Further, it is preferred but not required to apply some type of sealant at the head of the fastener at the sill 144.

Figure 5:
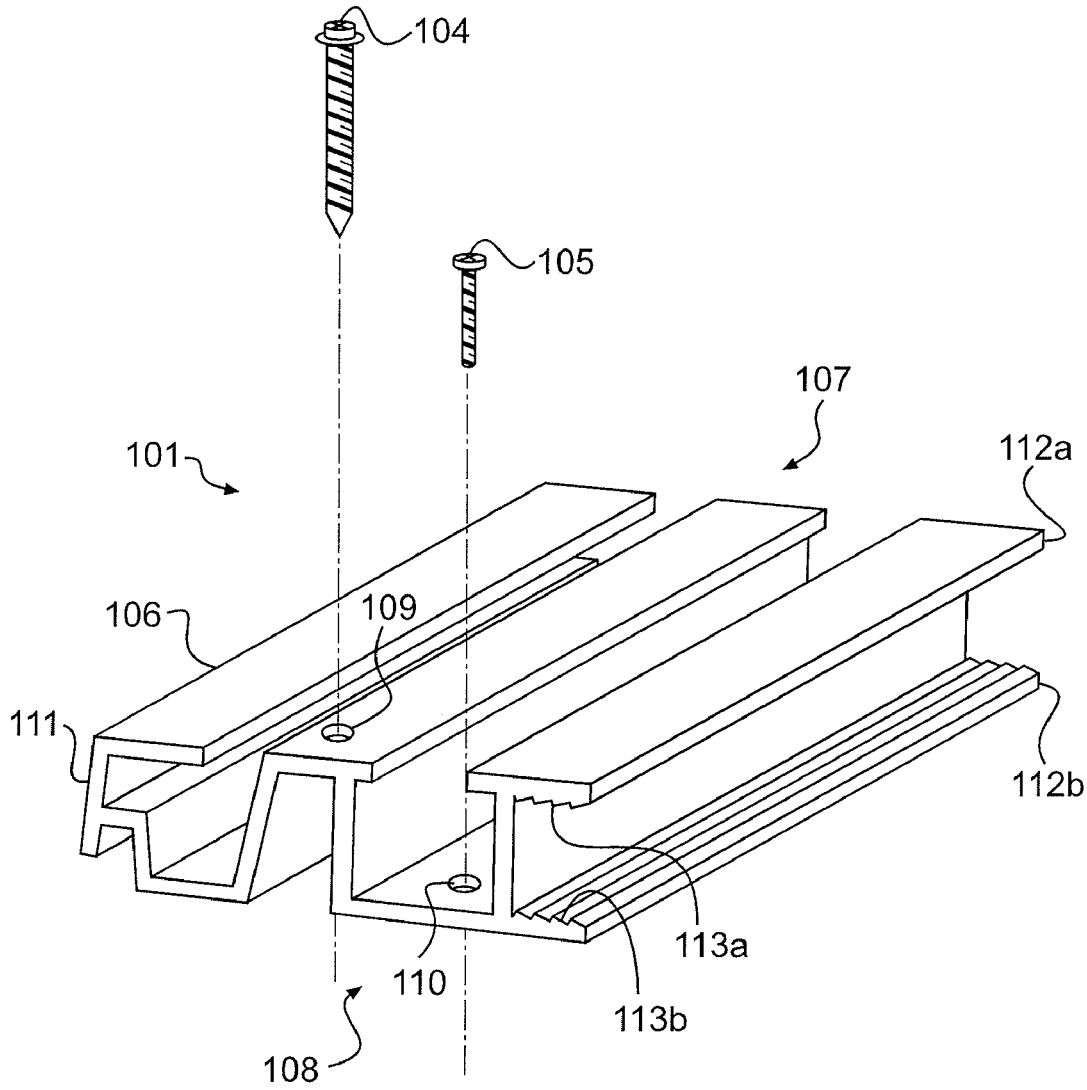
FIG. 5 is a perspective drawing of one embodiment of the receptor buck as appeared in the receptor system illustrated in FIG. 1 according to the present disclosure.
Figure 6:
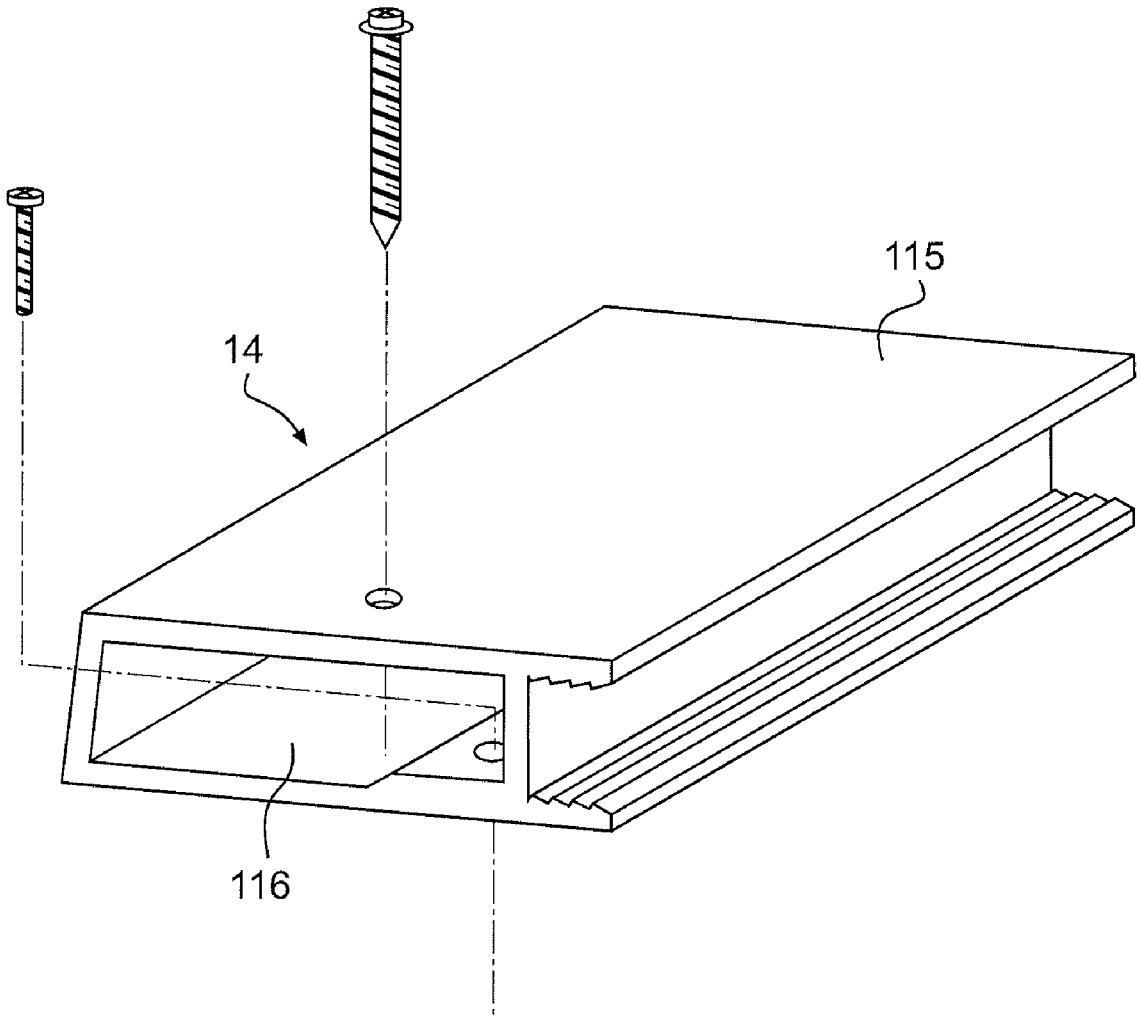
FIG. 6 is a perspective drawing of another embodiment of the receptor buck according to the present disclosure.
Figure 7A:
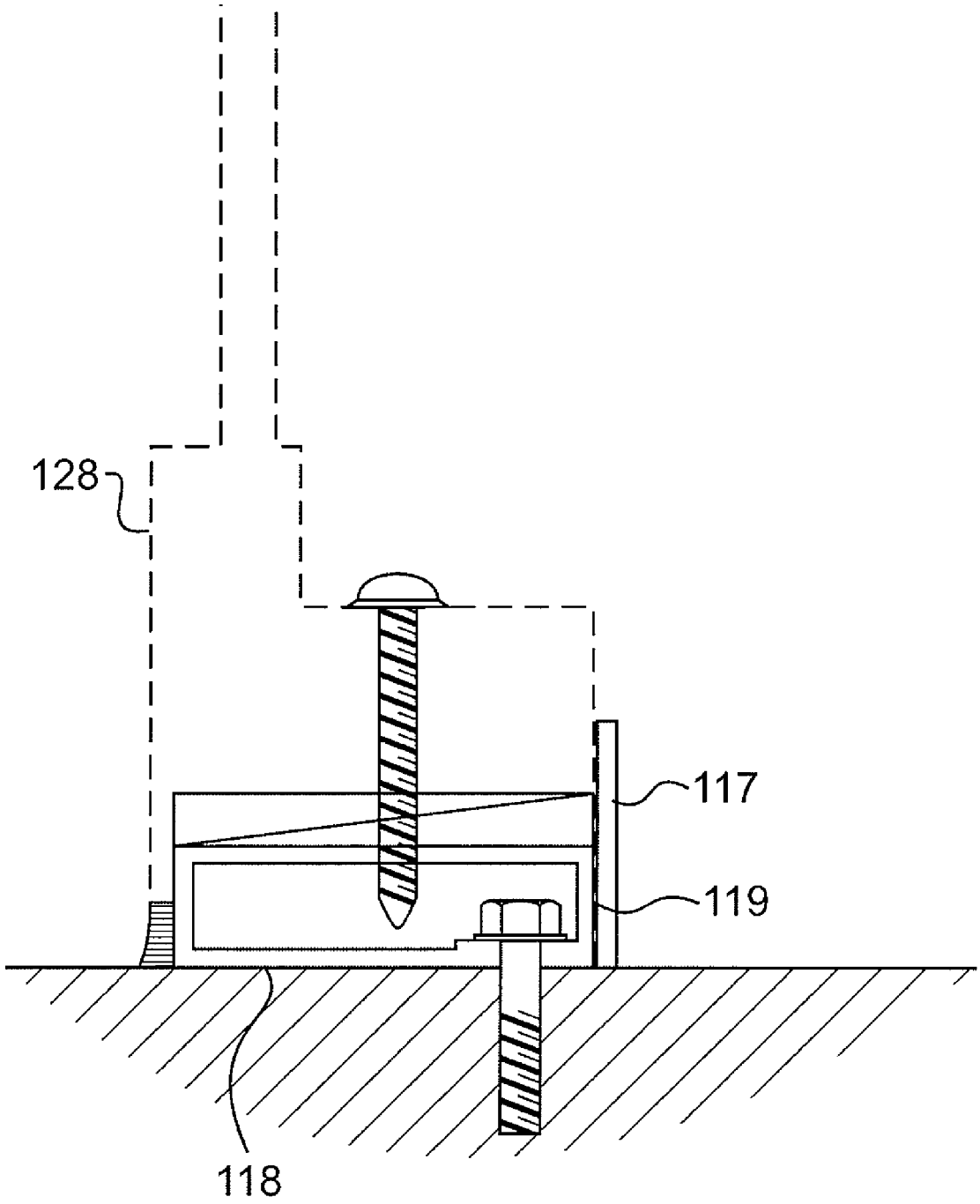
FIG. 7A is a cross sectional drawing of another embodiment of the receptor buck according to the present disclosure.

As shown in FIG. 5, the receptor buck 101 generally includes a rack 106 having a generally W-shaped cross section, an upper surface 107 and a bottom surface 108. However, it should be understood by those skilled in the art that receptor buck 101 may have cross-sectional shape other than a W-shape as long as the shape is suitable to resist the load borne by window 102 and frame 128. For example, the cross-sectional shape of the rack 106 may be defined as a closed polygon, as shown in FIGS. 6 and 7A. As shown in FIGS. 1 and 5, the receptor buck 101 prismatically extends in a generally longitudinal direction above the wall opening surface 103. The upper surface 107 includes at least one upper aperture 109 (in the form of, e.g., a through-hole), while the bottom surface 108 includes at least one base aperture 110 (in the form of, e.g., a through-hole) for accepting the fasteners therethrough. It is noted that the portion of the upper surface 107 including the upper aperture (also referred to as a frame fastener aperture) 109 is referred to as a first upper surface, and the vertical walls to the left and right of the upper aperture (when viewing the figures) are respectively referred to as a first vertical wall and a second vertical wall. The bottom surface 108 includes a first lower surface on the left side of the upper aperture 109 and a second lower surface on the right side of the upper aperture 109. It is also noted that the first vertical wall, second vertical wall and first upper surface define a frame fastener channel between the first and second lower surfaces, and the third vertical wall, second lower surface and second vertical wall define a wall fastener channel. The bottom surface 108 is secured to the wall opening surface 103 using base fastener 105 through base aperture 110, while frame 128 is secured onto the upper surface 107 using the upper fastener 101 through upper aperture 109. It is noted that the vertical walls to the left and right of the base aperture 110 (also referred to as a second lower surface aperture) (when viewing the figures) are respectively referred to the second vertical wall and a third vertical wall. An outer surface 111 (also referred to as a fourth vertical wall) on rack 106 may be included for accepting the back-bed sealant 146, and the rack may also accept sealant against the wall opening surface 103. Slot 136 (also referred to as a sub-channel) is defined by a generally L-shaped connector connecting a middle portion of the outer surface 111 and the first lower surface. Also, the generally L-shaped connector, first lower surface and first vertical wall define an outer channel, and the sub-channel is farther from the inside of the wall structure than the outer channel, frame fastener channel and the wall fastener channel. Also provided may be a second upper surface depending from a top of the fourth vertical wall toward the inside of the wall structure in the installed position and at least partially covering the entrance to the outer channel. Further provided may be a flange depending from and coplanar to the first upper surface and at least partially covering the wall fastener channel. An additional flange depending from the third vertical wall and being coplanar to the first upper surface may also be provided, wherein the flange at least partially covers the wall fastener channel. The rack 106 may also include channels 112*a,b* facing the interior of the structure, while teeth 113*a,b* are distributed on channels 112*a,b* for accepting e.g., claws 123*a,b* or other protrusions of an interior jamb cover 114 which may be snapped on or installed by other suitable methods, and can be adjustable depending on which set of teeth the cover is installed. The jamb cover 114, (in FIG. 1) and 117 (in FIGS. 7A and 7B) may be provided to hide any gaps that may occur between the receptor buck 101 and frame 128 due to field tolerances. The jamb covers 114, 117 (in FIGS. 7A and 7B) of the present disclosure may be installed on an inside and/or outside of the frame installation.

FIG. 6 shows another embodiment of the receptor buck 14. Most of the features of receptor buck 14 are identical to receptor buck 101 as shown in FIG. 5, except that the upper surface 115 and the bottom surface 116 of receptor buck 14 are each platform-like and not interrupted.

Figure 7B:
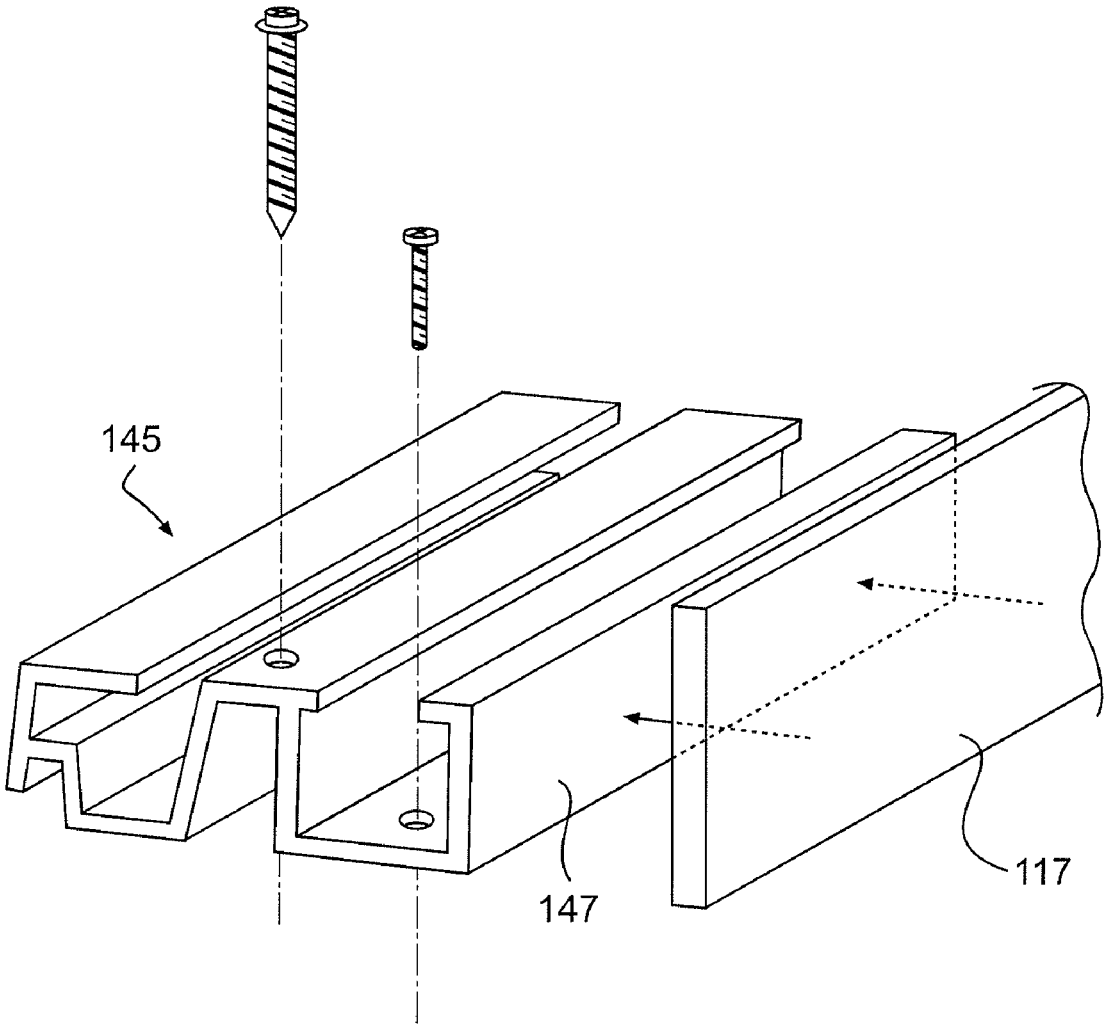
FIG. 7B is a perspective drawing of another embodiment of the receptor buck according to the present disclosure.

FIG. 7A shows another embodiment of the receptor buck 118, which may be used with a glue-on interior jamb cover 117 having a strip of material extends in generally a longitudinal direction along the rectangular cross-section receptor buck 118. Jamb cover 117 is usually attached to an interior surface 119 of the receptor buck 118 using glues or sealants, but can also be secured to the receptor buck 118 using fasteners, nails or any other suitable means for securing the jamb cover (not shown in FIG. 7A). FIG. 7B shows yet another embodiment of the receptor buck 145 that may be used with the glue-on interior jamb cover 117. Most of the features of receptor buck 145 are identical to the W-shaped receptor buck 101 as shown in FIG. 5, except that no channels are extended from the interior surface 147 of the receptor buck. Thus, the receptor buck 145 maintains a smooth interior surface 147 for accepting the glue-on interior jamb cover 117. It should be understood by those skilled in the art that receptor buck 145 may have cross-sectional shape other than a W-shape or rectangle so long as the receptor buck is suitable for resisting the load borne by window 102 and frame 128. In this configuration, the receptor buck may be positioned entirely (or at least substantially) below and completely or partially concealed by the flange frame 128, resulting in a thin installation profile, as shown in FIGS. 7A and 7B. It should be understood by those skilled in the art that other suitable methods of affixing jamb cover 117 to the receptor buck may be implemented.

The receptor buck may be hollow or partially or completely solid and may also be formed by a variety of materials, including but not limited to aluminum, stainless steel, polymers, etc., depending on the load imposed of the frame 128.

In FIG. 1, as discussed above, the frame 128 may further include a flange 120 at its exterior edge. The back-bed sealant 146 may be applied between the inner surface of the flange 120 and the outer surface 111 of the receptor buck 101. Under such configuration, the flange 120 covers a portion of the receptor buck 101 as well as conceals the gap between the receptor buck 101 and frame 128. A perimeter sealant 121 may be further applied to fill the gap among the receptor buck 101, the frame 128 and the wall opening surface 103. By installing the back-bed sealant 146 between the inner surface of the flange 120 and the outer surface 111 of the receptor buck, the back-bed sealant 146 is hidden from view as well as from the elements, thereby making the back-bed sealant 146 last longer. Further, as shown in FIG. 1, the receptor buck 101 allows the frame 128 to be sealed (with e.g., perimeter sealant 121) at a single location, rather that at multiple locations on multiple occasions (e.g., installing sealant between the wall opening surface 103 and receptor buck 101, and then between the receptor buck 101 and the frame 128), thus further facilitating the ease of installation.

To install the receptor system 100, receptor buck 101 is placed above the wall opening surface 103 and if possible, on a bed of sealant. The base fastener 105 is inserted through base aperture 110 into the masonry 122 to hold the receptor buck 101 in place. The frame 128 is placed on receptor buck 101, where the upper fastener 104 is inserted through an aperture on the frame 128 into the upper aperture 109 to secure the frame to the receptor buck 101. The aperture 109 may be created in the field during installation. In other words, the receptor buck 101 may be provided without the aperture 109, so that the installer may make one or more apertures 109 in the receptor buck that readily align with frame apertures of the frame 128, in order to facilitate installation. To prevent leaking, a back-bed sealant 146 may be applied to seal the gap between the outer surface 111 of the rack 106 and the inner surface of the flange 120. The perimeter sealant 121 is preferably further applied to fill the gap among the edge of the flange 120, the lower portion of outer surface 111 and the wall opening surface 103 at a single location, as disclosed above.

Since the upper surface 107 of the receptor buck is generally parallel to the bottom surface 108, upper fastener 104 and base fastener 105 respectively inserted into apertures on each of those surfaces, are generally perpendicular to those surfaces are parallel to each other (as shown in FIG. 5). By installing upper fasteners 104 and base fastener 105 in a direction generally parallel to each other, the frame 128 may be more securely installed to the receptor buck 101 and in turn the opening surface 103, such that the window or door frame 128 may be more resistant to impact, than for example, a frame secured to a receptor using fasteners installed in a direction oblique or orthogonal to each other. It should also be understood by those skilled in the art that the above receptor system 100 may be installed in an opening in an order different from that previously described.

An interior jamb cover may be implemented to hide the gap between frame 128 and receptor buck 101 at the interior of the structure. FIG. 1 shows the receptor system 100 with a snap-on interior jamb cover 114 having claws 123*a,b* or any other protrusions. The teeth 113*a,b* on channels 112*a,b* of rack 106 are configured to interlock with claws 123*a,b* of the interior jamb cover 114 to secure jamb cover 114 to the receptor buck 101. It should be understood by those skilled in the art that the jamb cover 114 may be installed in any suitable way other than using a snap-on configuration.

FIGS. 2 and 3 illustrate a configuration of receptor system 100 when one or more actual dimensions of the actual opening 124 are inconsistent with the predetermined design dimension 125. In FIG. 1, an intermediary shim 127 is inserted between the receptor buck 101 and frame 128 to increase the tolerance range of the wall opening. FIG. 2 illustrates the configuration of receptor system 100 when the actual opening dimension 124 is smaller than the predetermined design dimension 125, but slightly larger than or equivalent to the overall dimension of receptor system 126. The intermediary shim 127 may not be implemented as originally planned. Accordingly, the frame 128 may be secured directly above receptor buck 101. This configuration reduces the overall profile of the receptor system 100 and allows the receptor system 100 to fit into an opening of a smaller-than-expected (i.e., smaller than desired) wall, yet still being impact resistant. In addition, to enhance the receptor system, the upper surface 107 of the receptor buck 101 may include protrusions 101*a,b,c*, upon which frame projections 129*a,b,c* may press, for evenly distributing the load of the frame 128 on receptor buck 101, further resulting in a stronger installation.

Figure 4:
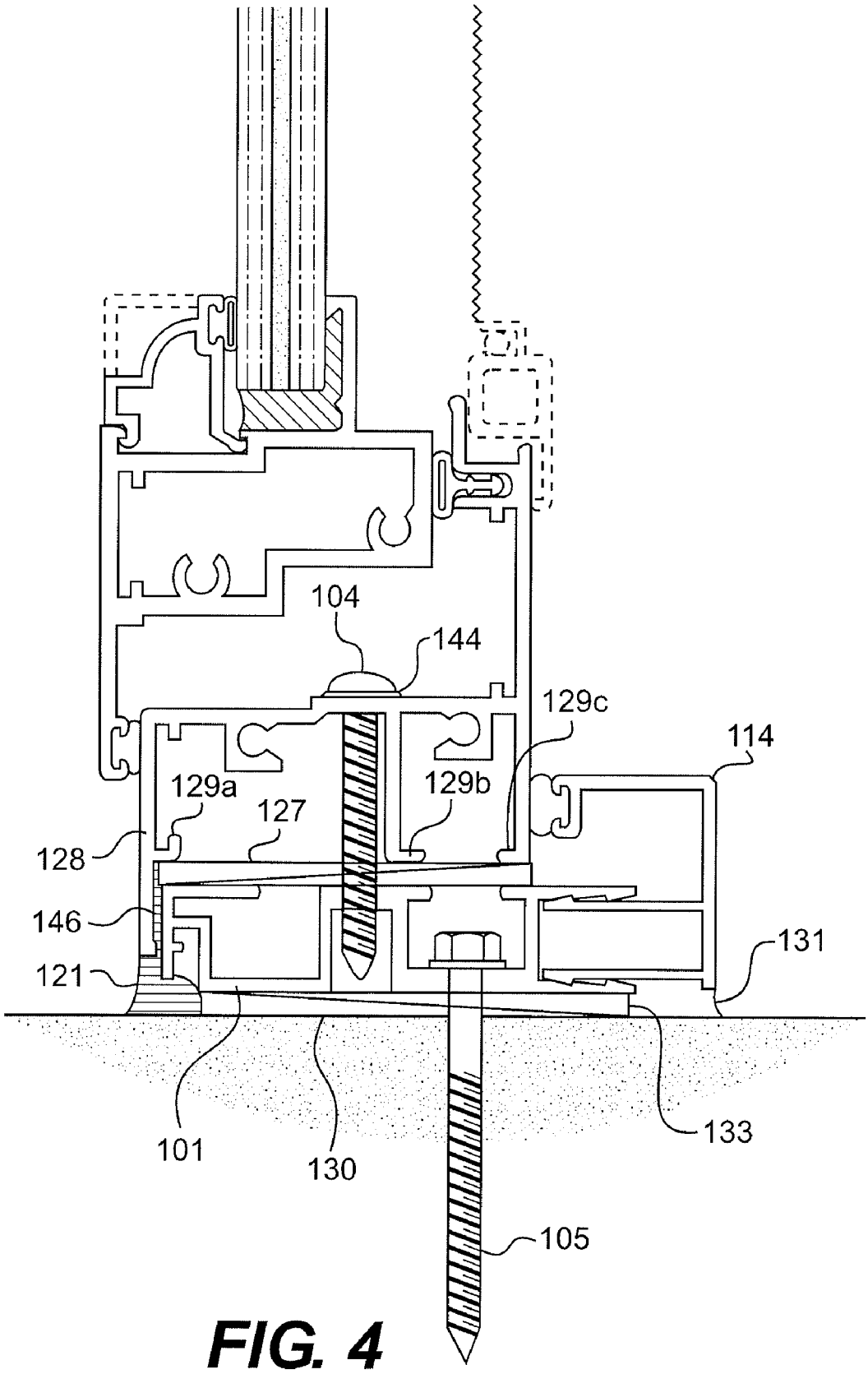
FIG. 4 is a partial magnified cross sectional drawing of the receptor system illustrated in FIG. 3 according to the present disclosure.

When the actual wall opening dimension 124 is larger than the predetermined design dimension 125, as shown in FIGS. 3 and 4, one or both intermediary shim 127 and base shim 130 are used with the receptor system 100. Intermediary shim 127 is installed between the frame 128 and receptor buck 101, with projections 129*a,b,c* distributing the load of the frame on the receptor buck 101 through intermediary shim 127. Intermediary shim 127 may further include an aperture (or other opening) for accepting the upper fastener 104 therethrough to prevent itself from displacement. The intermediary shim 127 may be made of wood or other suitable material. Additionally, base shim 130 may be installed between the receptor buck 101 and the wall opening surface 103 to reconcile the difference between the predetermined design dimension 125 and the actual opening dimension 124. Base shim 130 may further include an aperture for accepting base fastener 105. To conceal base shim 130 from the receptor system 100, the perimeter sealant 121 and an additional interior perimeter sealant 131 may be applied to cover the exterior surface 132 and interior surface 133 of the base shim 131, respectively. The height of intermediary shim 127 and base shim 130 is also adjustable depending on the dimensional difference between the actual wall opening dimension 124 and the predetermined design dimension 125. Alternatively or additionally, the shims 127 and 130 may be generally uniform in height and the number of shims used in the receptor system 100 may be varied, depending on the application.

Figure 8:
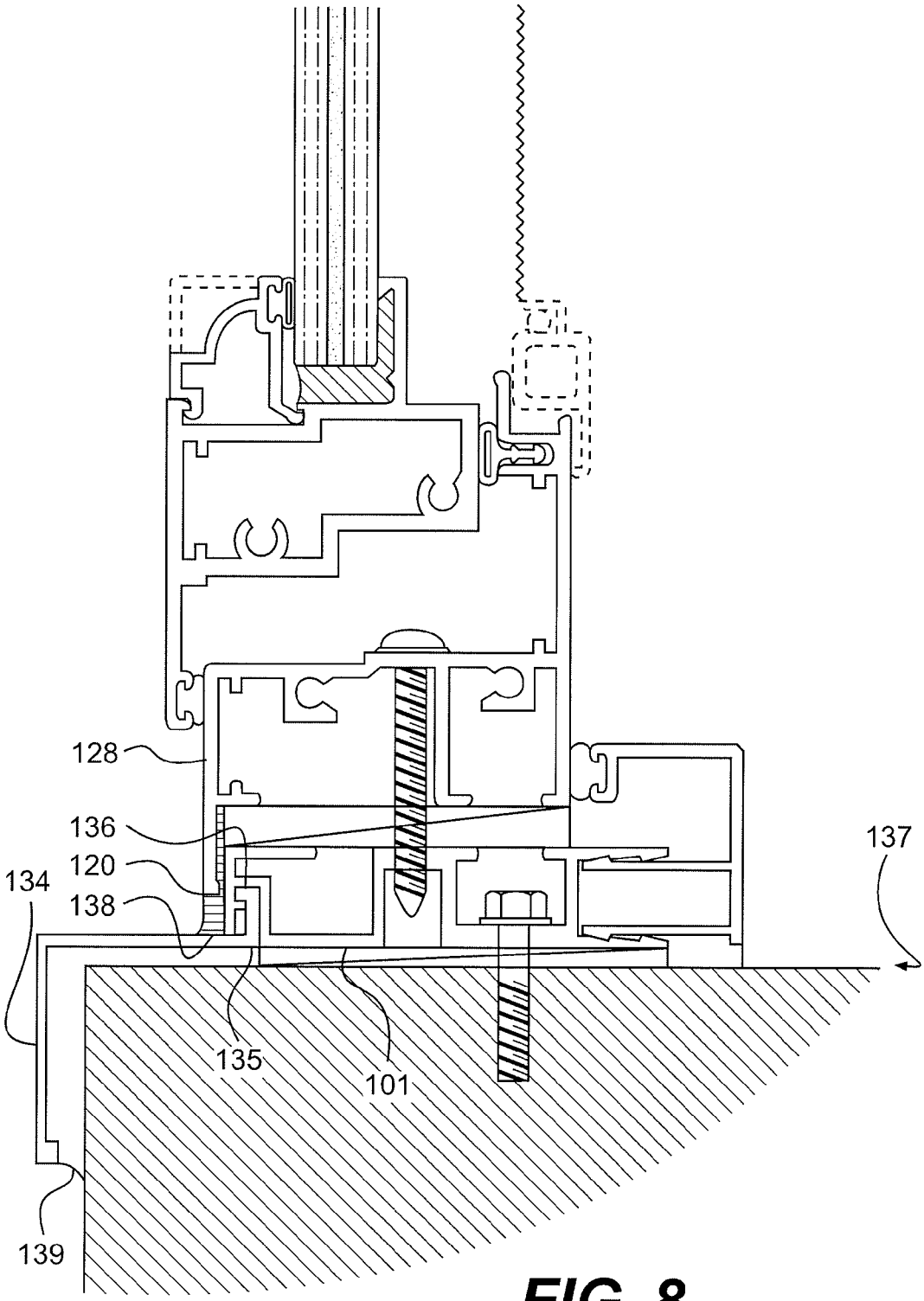
FIG. 8 is a cross sectional drawing illustrating the receptor system illustrated in FIG. 1 with an exterior molding according to the present disclosure.

FIG. 8 illustrates the receptor system 100, further including an exterior molding 134 to strengthen the receptor system and improve the overall appearance of the receptor system, and can trim between different exterior wall materials. An inner component 135 of exterior molding 134 may be inserted into a slot 136 on receptor buck 101, while the remaining portion of the exterior molding 134 is extended about the exterior surface of the wall opening 137. A perimeter sealant 138 may be applied to seal the gap among flange 120, receptor buck 101 and the upper portion 138 of the exterior molding 134. A second perimeter sealant 139 is applied between exterior molding 134 and the surface of the wall opening 137.

Figure 9:
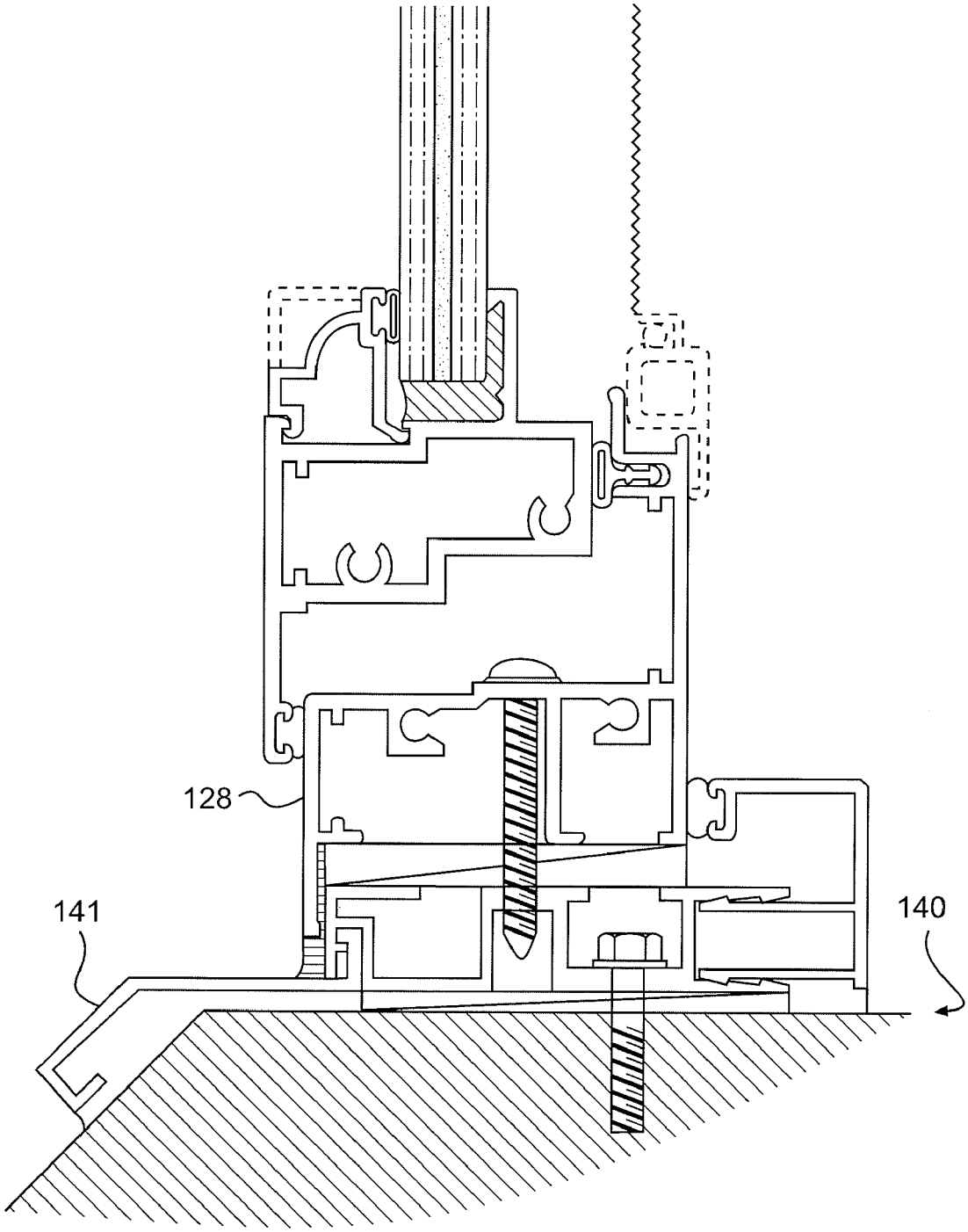
FIG. 9 is a cross sectional drawing illustrating the receptor system illustrated in FIG. 1 with a slant exterior molding according to the present disclosure.

If the receptor system 100 is mounted on a surface of a slanted wall, the shape of the exterior trim 141 can be tailored to fit the shape of the exterior surface of the slant wall 140, as shown in FIG. 9. The trim 141 (which may be extruded or formed) may be installed on the inside and/or the outside of the frame 128 installation.

Figure 10:
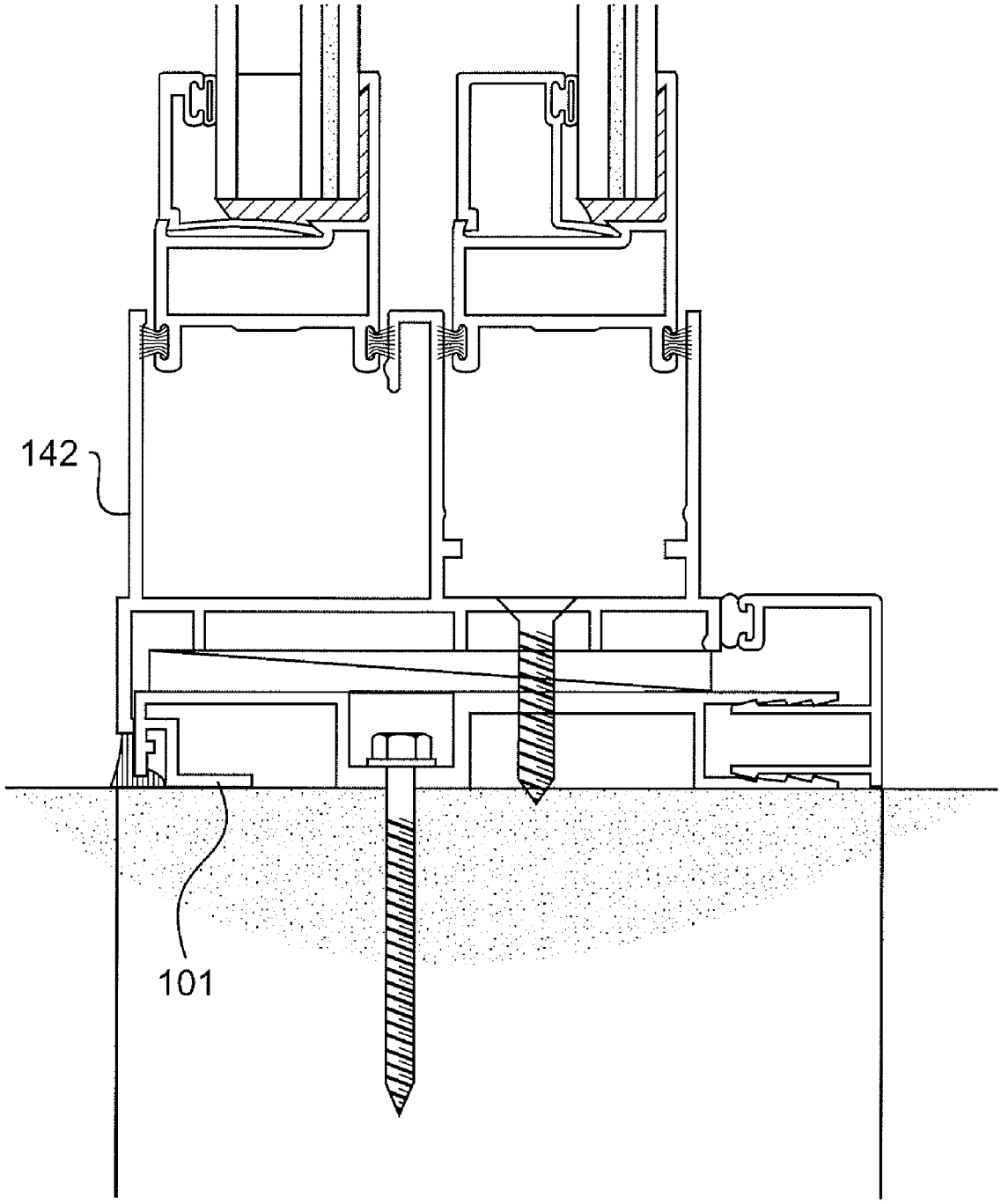
FIG. 10 is a cross sectional drawing illustrating another embodiments of the receptor system with a different frame according to the present disclosure.
Figure 11:
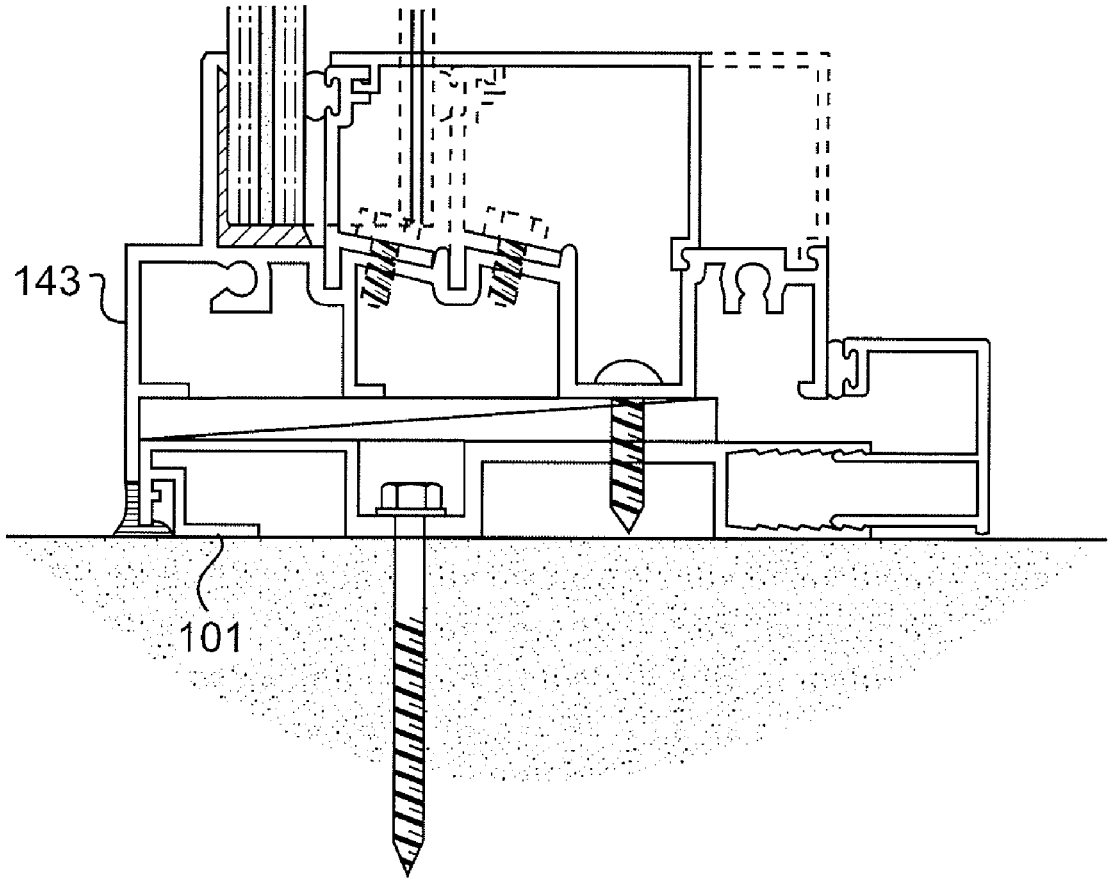
FIG. 11 is a cross sectional drawing illustrating another embodiments of the receptor system with a different frame according to the present disclosure.
Figure 12:
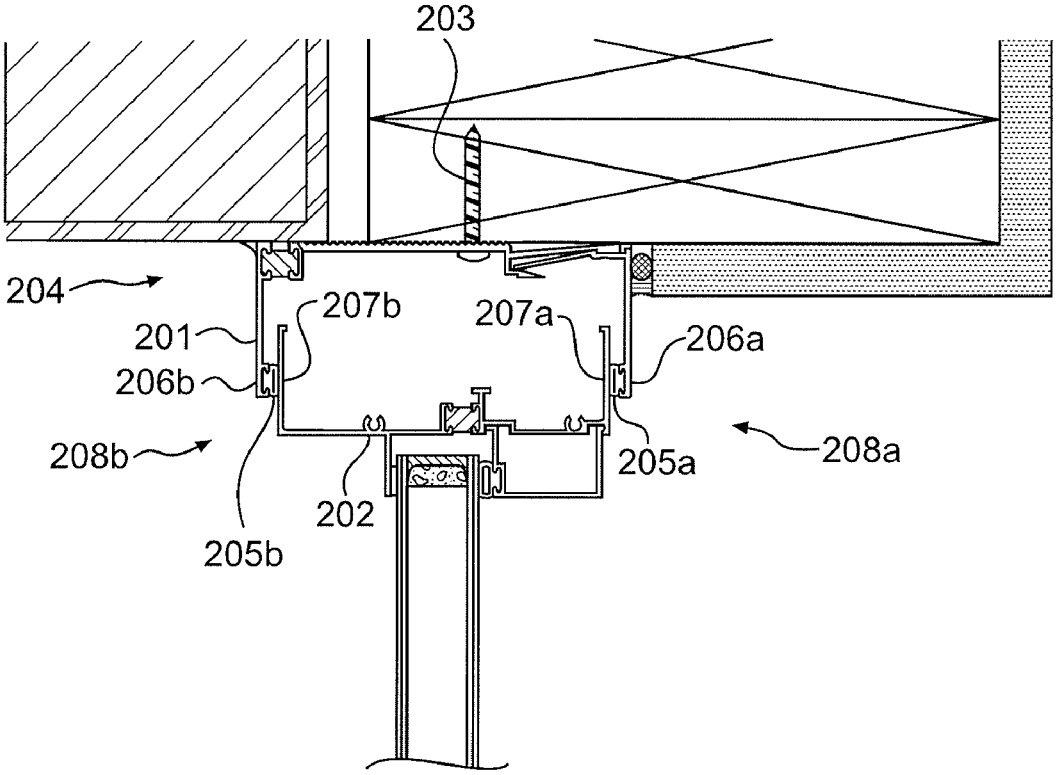
FIG. 12 (PRIOR ART)
FIG. 12 is a sectional drawing of a known receptor system.
Figure 13:
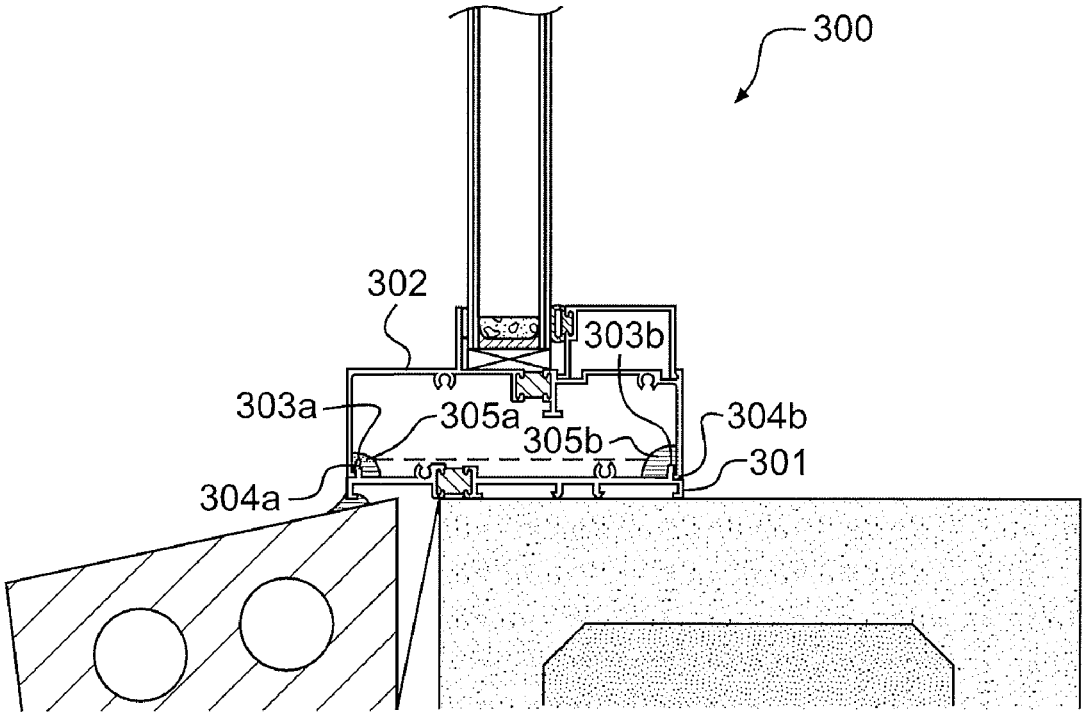
FIG. 13 (PRIOR ART)
FIG. 13 is a sectional drawing of a receptor system generally known in the field of the art.

FIGS. 10 and 11 illustrate other embodiments of the receptor system featuring the receptor buck 101 being installed with frames 142 and 143, respectively.

It is noted that the foregoing examples have been provided merely for the purpose of explanation and are in no way to be construed as limiting of the present disclosure. While the present disclosure has been described with reference to a preferred embodiment, it is understood that the words which have been used herein are words of description and illustration, rather than words of limitation. Changes may be made, within the purview of the appended claims, as presently stated and as amended, without departing from the scope and spirit of the present disclosure in its aspects. Although the present disclosure has been described herein with reference to particular means, materials and embodiments, the present disclosure is not intended to be limited to the particulars disclosed herein; rather, the present disclosure extends to all functionally equivalent structures, methods and uses, such as are within the scope of the appended claims.

What is claimed is:

1. A receptor buck for securing at least one of a window frame and a door frame to a wall structure, said receptor buck comprising:

a rack extending in a width direction of the at least one of the window frame and the door frame in an installed position, the rack comprising:

a first lower surface configured to be installed flush against the at least one of the window frame and the door frame in the installed position;

a second lower surface configured to be installed flush against the at least one of the window frame and the door frame in the installed position, wherein:

the second lower surface is coplanar with the first lower surface;

the second lower surface comprises a second lower surface aperture configured to accept a wall fastener for fastening the rack to a surface of an opening of the wall structure; and the second lower surface is closer to an inside of the wall structure than the first lower surface, in the installed position;

a first upper surface parallel to the first and second lower surfaces and lying in a plane different than the plane of the first and second lower surfaces, wherein the first upper surface comprises a frame fastener aperture configured to accommodate a frame fastener for fastening the at least one of the window frame and the door frame to the rack, in the installed position;

a first vertical wall and connecting the first upper surface to the first lower surface;

a second vertical wall orthogonal to and connecting the first upper surface and the second lower surface, wherein the first vertical wall, second vertical wall and first upper surface define a frame fastener channel between the first and second lower surfaces and facing away from the at least one of the window frame and the door frame in the installed position, into which the frame fastener extends in a direction parallel to the second vertical wall and the wall fastener, in the installed position;

a third vertical wall orthogonal to and connected to the second lower surface such that the third vertical wall, second lower surface and second vertical wall define a wall fastener channel which is closer to the inside of the wall structure than the frame fastener channel, wherein:

the wall fastener channel faces in a direction opposite the direction the frame fastener faces; and the wall fastener channel is configured to accommodate the wall fastener;

a fourth vertical wall parallel to the second vertical wall and which is further from the inside of the wall structure than the first, second and third vertical walls;

a generally L-shaped connector connecting a middle portion of the fourth vertical wall to the first lower surface such that the generally L-shaped connector and fourth vertical wall define a sub-channel facing away from the at least one of the window frame and the door frame in the installed position; wherein:

the generally L-shaped connector, first lower surface and first vertical wall define an outer channel facing in the same direction as the wall fastener channel;

the sub-channel is farther from the inside of the wall structure than the outer channel, frame fastener channel and the wall fastener channel; and the first lower surface, second lower surface, first upper surface, first vertical wall, second vertical wall, third vertical wall, fourth vertical wall, generally L-shaped connector are unitarily formed from a single piece of material.

2. The receptor buck according to claim 1, wherein said rack is configured to accept a flange of at least one of the window frame and the door frame.

3. The receptor buck according to claim 1, further comprising an exterior-facing surface on said rack and facing an exterior of the structure, said third surface configured to accept a back-bed sealant thereon.

4. The receptor buck according to claim 3, wherein at least a portion of said exterior-facing surface touches a flange of at least one of the window frame and the door frame.

5. The receptor buck according to claim 3, wherein said exterior-facing surface is further configured to accept a perimeter sealant.

6. The receptor buck according to claim 1, further comprising at least one channel extending from said rack and facing an interior of the structure, said channel configured to accept an interior jamb cover.

7. The receptor buck according to claim 1, wherein at least the first fastener is concealed.

8. The receptor buck according to claim 1, wherein said rack is configured to fit generally completely under the at least one of the window frame and the door frame.

9. The receptor buck according to claim 1, further comprising a second upper surface depending from a top of the fourth vertical wall toward the inside of the wall structure in the installed position, and at least partially covering the entrance to the outer channel, wherein the second upper surface is coplanar to the first upper surface.

10. The receptor buck according to claim 1, further comprising a flange depending from and coplanar to the first upper surface and at least partially covering the wall fastener channel.

11. The receptor buck according to claim 1, further comprising a flange depending from the third vertical wall and being coplanar to the first upper surface, wherein the flange at least partially covers the wall fastener channel.

12. The receptor buck according to claim 1, further comprising:

a first flange depending from and coplanar to the first upper surface and partially covering the wall fastener channel; and a second flange depending from the third vertical wall and being coplanar to the first upper surface, wherein the second flange partially covers the wall fastener channel.

13. The receptor buck according to claim 1, wherein the first vertical wall is orthogonal to the first lower surface.

14. A receptor system for securing at least one of a window frame and a door frame, comprising:

a receptor buck comprising:

a rack extending in a width direction of the at least one of the window frame and the door frame in an installed position, the rack comprising:

a first lower surface configured to be installed flush against the at least one of the window frame and the door frame in the installed position;

a second lower surface configured to be installed flush against the at least one of the window frame and the door frame in the installed position, wherein:

the second lower surface is coplanar with the first lower surface;

the second lower surface comprises a second lower surface aperture configured to accept a wall fastener for fastening the rack to a surface of an opening of the wall structure; and the second lower surface is closer to an inside of the wall structure than the first lower surface, in the installed position;

a first upper surface parallel to the first and second lower surfaces and lying in a plane different than the plane of the first and second lower surfaces, wherein the first upper surface comprises a frame fastener aperture configured to accommodate a frame fastener for fastening the at least one of the window frame and the door frame to the rack, in the installed position;

a first vertical wall and connecting the first upper surface to the first lower surface;

a second vertical wall orthogonal to and connecting the first upper surface and the second lower surface, wherein the first vertical wall, second vertical wall and first upper surface define a frame fastener channel between the first and second lower surfaces and facing away from the at least one of the window frame and the door frame in the installed position, into which the frame fastener extends in a direction parallel to the second vertical wall and the wall fastener, in the installed position;

a third vertical wall orthogonal to and connected to the second lower surface such that the third vertical wall, second lower surface and second vertical wall define a wall fastener channel which is closer to the inside of the wall structure than the frame fastener channel, wherein:

the wall fastener channel faces in a direction opposite the direction the frame fastener faces; and the wall fastener channel is configured to accommodate the wall fastener;

a fourth vertical wall parallel to the second vertical wall and which is further from the inside of the wall structure than the first, second and third vertical walls;

a generally L-shaped connector connecting a middle portion of the fourth vertical wall to the first lower surface such that the generally L-shaped connector and fourth vertical wall define a sub-channel facing away from the at least one of the window frame and the door frame in the installed position; wherein:

the generally L-shaped connector, first lower surface and first vertical wall define an outer channel facing in the same direction as the wall fastener channel;

the sub-channel is farther from the inside of the wall structure than the outer channel, frame fastener channel and the wall fastener channel; and the first lower surface, second lower surface, first upper surface, first vertical wall, second vertical wall, third vertical wall, fourth vertical wall, generally L-shaped connector are unitarily formed from a single piece of material, a first fastener configured to fasten the rack of said receptor buck to the surface of the wall opening of the structure through the first aperture on the first upper surface; and a second fastener configured to fasten the at least one of the window frame and the door frame to the rack of said receptor buck through the second aperture on the second lower surface on the rack of said receptor buck, wherein the second fastener extends in a generally same direction as the first fastener.

15. The receptor system according to claim 14, wherein at least one of the first fastener and the second fastener is a screw.

16. The receptor system according to claim 14, wherein at least one of the first fastener and the second fastener is a bolt.

17. The receptor system according to claim 14, further comprising a shim configured to be installed between the rack of said receptor buck and the at least one of the window frame and the door frame, said shim extending in a generally same direction as the rack of said receptor buck.

18. The receptor system according to claim 17, wherein a surface on said shim further comprises a shim aperture configured to accept the second fastener.

19. The receptor system according to claim 14, further comprising a shim configured to be installed between the rack of said receptor buck and the surface of the wall opening, said shim extending in a generally same direction as the rack of said receptor buck.

20. The receptor system according to claim 19, wherein a surface on said shim further comprises a shim aperture configured to accept the first fastener.

21. The receptor system according to claim 14, wherein the rack of said receptor buck is selectively installed to a section of the surface of the wall opening.

22. The receptor system according to claim 14, wherein a shape of the rack of said receptor buck is configured to match a shape of the surface of the wall opening.

23. The receptor system according to claim 14, further comprising an interior jamb cover comprising a projection and facing an interior of the structure, the projection attached to a channel of the rack of said receptor buck, said interior jamb cover extending in a generally same direction as the rack of said receptor buck.

24. The receptor system according to claim 14, further comprising an interior jamb cover, wherein said interior jamb cover configured to be adhered onto an interior surface of the rack of said receptor buck.

25. The receptor system according to claim 14, further comprising an exterior molding attaching to the rack of said receptor buck and facing an exterior of the structure, said exterior molding extending in a generally same direction as the rack of said receptor buck.

26. The receptor system according to claim 25, wherein said exterior molding is selectively installed to a section of the surface of the wall opening.

27. The receptor system according to claim 14, wherein at least the first fastener is concealed.

28. The receptor system according to claim 14, further comprising a perimeter sealant configured to seal a gap among the rack of said receptor buck, at least one of said window frame and door frame and the surface of the wall opening.

29. The receptor system according to claim 14, wherein an edge of at least one of the window frame and the door frame comprises at least one of a flange and a lip portion.

30. The receptor system according to claim 29, further comprising a back-bed sealant configured to seal a gap between an outer surface of the rack of said receptor buck and an inner surface of at least one of the flange and the lip portion.

31. The receptor system according to claim 14, wherein at least one of the window frame and the door frame comprises a projection, said projection is configured to exert a load of at least the window frame and the door frame on the second surface of the rack of said receptor.

* * * * *